US005164703A

United States Patent [19]

Rickman

[11] Patent Number: 5,164,703

[45] Date of Patent: Nov. 17, 1992

[54] AUDIO INTRUSION DETECTION SYSTEM

[75] Inventor: Stephen A. Rickman, Loomis, Calif.

[73] Assignee: C & K Systems, Inc., Folsom, Calif.

[21] Appl. No.: 694,824

[22] Filed: May 2, 1991

[51] Int. Cl.[5] ..... G08B 29/00

[52] U.S. Cl. ..... 340/515; 340/514; 340/522; 340/566

[58] Field of Search ..... 340/515, 514, 565, 566, 340/541, 522; 367/197-199, 93, 136

[56] References Cited

U.S. PATENT DOCUMENTS

| | | | |
|---|---|---|---|
| 4,386,343 | 5/1983 | Shiveley | 340/515 |
| 4,710,750 | 12/1987 | Johnson | 340/522 |
| 4,853,677 | 8/1989 | Yarbrough et al. | 340/544 |
| 4,920,332 | 4/1990 | Philippe | 340/566 |
| 4,928,085 | 5/1990 | DuRand, III et al. | 340/566 |
| 4,950,915 | 8/1990 | Spies et al. | 340/515 |

*Primary Examiner*—Donnie L. Crosland

*Attorney, Agent, or Firm*—Limbach & Limbach

[57] ABSTRACT

A supervisory circuit for use with an audio intrusion detection system is disclosed. The supervisory circuit periodically generates an audio test signal which is supplied to a sounder which emits an audio test sound. The audio test sound is directed into a volume of space, in the same volume of space as which the audio intrusion detection system is directed to detect. The audio intrusion detection system detects the test sound and generates an audio test signal in response thereto. During the generation of the audio test sound, the comparing apparatus of the audio intrusion detection system is disabled. The audio test signal generated by the audio intrusion detection system is then compared to a test threshold signal. A test result signal is generated in response to the comparison with the test result signal indicative of the operability of the audio intrusion detection system.

16 Claims, 5 Drawing Sheets

Q2
2N3415
14
R16
20K
CR5
U8B
4013
24
NC
C17
.001
48a
RN3
47K
CR3
U7A
4013
20
$V_C$
R14
1M
U2/A
LM 324
22
RN3
100K
C11
.01
U78
4013
62
CR1
46a
U8A
4013
18
R9
1.2M
C7
.22
R10
100K
PP
4
U6
4541
16
RTC
CTC
RS
Q
A
B
AR
MO
Q/Q̄
R
60
R1
47K
PP
1
RN3
10K
PP
2
PP
3
S1
C
NO
TAMPER

AUDIO INTRUSION DETECTION SYSTEM

TECHNICAL FIELD

The present invention relates to an audio intrusion detection system having an audio sensor and a pressure sensor, and more particularly to a supervisory circuit for use with an audio intrusion detection system.

BACKGROUND OF THE INVENTION

Audio intrusion detection systems having an audio sensor as well as a pressure sensor are well known. See, for example, U.S. Pat. No. 4,853,677 and 4,928,085. Supervisory circuits to detect faults in a dual-sensing intrusion detection system are also well known in the art. See, for example, U.S. Pat. No. 4,710,750.

SUMMARY OF THE INVENTION

In the present invention, a supervisory circuit for use with an audio intrusion detection system is disclosed. The audio intrusion detection system has means for generating an electrical audio signal in response to the detection of an audio intrusion sound and for comparing the electrical audio signal to an audio threshold signal and for generating an audio alarm signal in response to the comparison. The improvement comprises a supervisory circuit which has means for generating a test audio sound. The supervisory circuit further has means for disabling the comparing means of the audio intrusion detection system during the generation of the test audio sound. Further, the supervisory circuit has means for receiving the audio signal from the audio intrusion detection system generated in response to the detection of the test audio sound and for comparing the audio signal to a test threshold signal. Finally, the supervisory circuit has means for generating a test result signal in response to the comparison wherein the test result signal is indicative of the operability of the audio intrusion detection system.

DETAILED DESCRIPTION OF THE DRAWINGS

Figure 1:
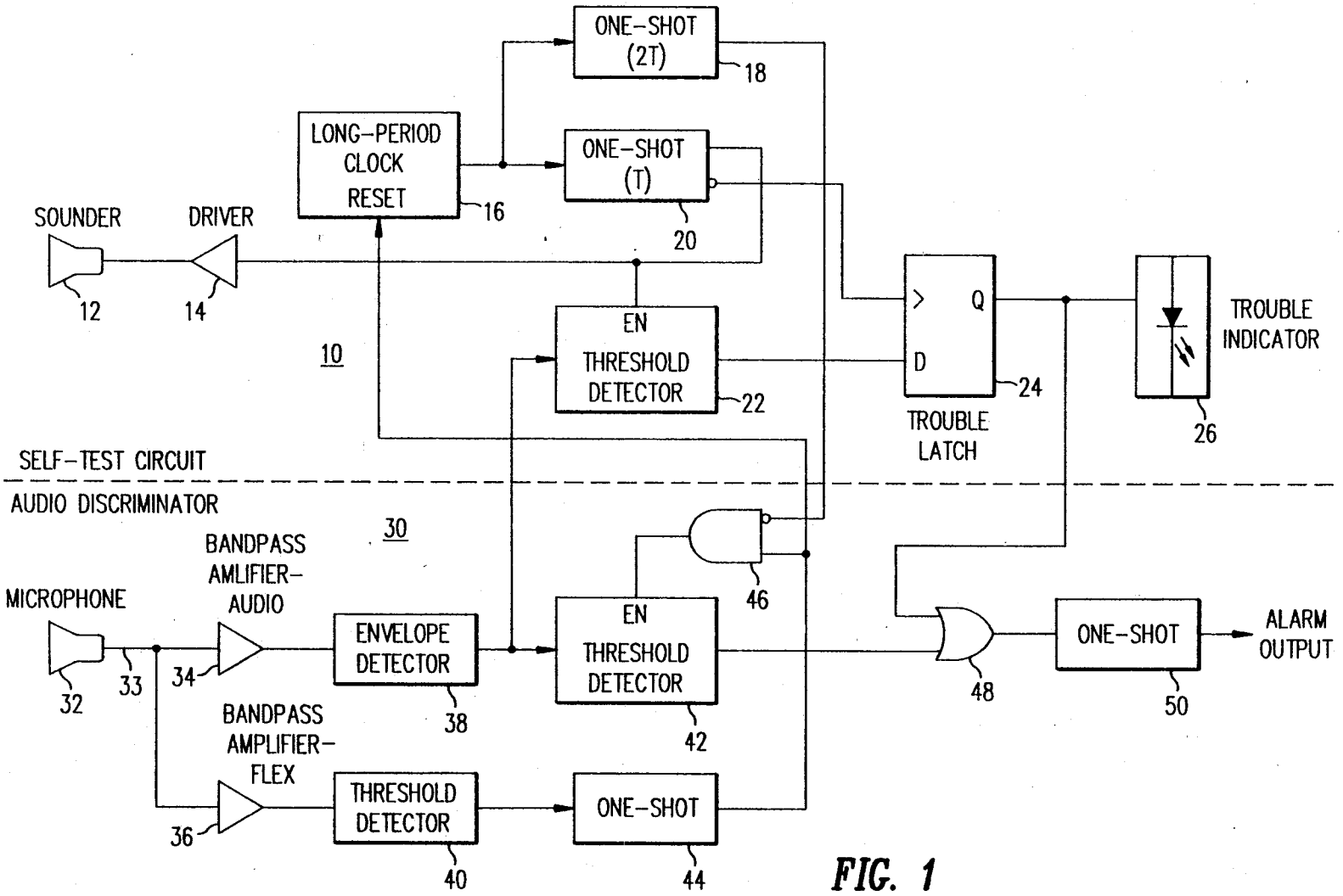
FIG. 1 is a schematic block level diagram of the supervisory circuit of the present invention for use with an audio intrusion detection system having an audio sensor as well as a pressure sensor.

Referring to FIG. 1 there is shown a supervisory circuit 10 of the present invention for use with an audio intrusion detection system 30. The audio intrusion detection system 30 is of conventional design.

The audio intrusion detection system 30 is of the dual sensing type in that a single microphone 32 receives either a pressure wave or a sound caused by the presence of an intruder generated in the same volume of space. The microphone 32 generates a signal 33 in response to this detection. The signal 33 is supplied to a first bandpass amplifier filter 34. The first bandpass amplifier filter 34 is adapted to pass the audio portion of the signal 33, i.e., substantially between 7 kHz and 16 kHz. The output of the first bandpass amplifier filter 34 is supplied to an envelope detector 38. The envelope detector 38 removes the audio frequencies and leaves a signal that follows the original peak-to-peak "envelope" of the input signal. This signal indicates the loudness of the sound. From the envelope detector 38, the signal is supplied to a threshold detector 42. The threshold detector 42 determines if the signal from the envelope detector 38 exceeds a certain threshold level. If the signal from the envelope detector 38 exceeds a preset threshold level, then the threshold detector 42 generates a signal which is supplied to an OR gate 48. From the output of the OR gate 48, the signal is supplied to a first one shot 50 which holds the signal and produces an alarm output.

The signal 33 from the microphone 32 is also supplied to a second bandpass amplifier filter 36. The second bandpass amplifier filter 36 filters the signal 33 and generates a filtered signal which represents the pressure wave portion detected by the microphone 32. The output of the second bandpass amplifier filter 36 is a signal having substantially a frequency range of between 3 to 30 Hz. The output of the second bandpass amplifier 36 is supplied to a second threshold detector 40. The second threshold detector 40, similar to the first threshold detector 42, determines if the signal from the second bandpass amplifier filter 36 exceeds a certain threshold. If the signal from the second bandpass amplifier 36 exceeds the threshold as determined by the second threshold detector 40, then a signal is generated which is supplied to a second one shot 44. The second one shot 44 also holds the signal. The output of the second one shot 44 is an alarm signal indicative of the detection of a pressure wave, presumably caused by an intruder.

The supervisory circuit 10 of the present invention for use with the audio detection system 30 comprises a clock 16. The clock 16 has a reset which is reset by the output of the second one shot 44. The clock 16 periodically generates a signal which is supplied to a third one shot 18 and a fourth one shot 20. The fourth one shot 20, in response to the signal received from the clock 16, maintains the signal for a time period T. The third one shot 18, in response to the signal from the clock 16, maintains the signal for a time period of 2T, or twice as long as the signal from the fourth one shot 20. The signal from the third one shot 18 is supplied to the inverted input of an AND gate 46. The other input to the AND gate 46 is from the output of the second one shot 44. The output of the AND gate 46 is used to enable or disable the first threshold detector 42.

The fourth one shot 20, receives the output of the clock 16 and maintains it for a time period T. The signal from the fourth one shot 20 is used to enable a third threshold detector 22 and is also supplied to a driver 14 which is supplied to a sounder 12. The signal from the fourth one shot 20 is used to generate an audio test sound by the sounder 12.

The third threshold detector 22 receives as its input the signal from the output of the envelope detector 38. In response thereto and in response to the signal from the fourth one shot 20, enabling or disabling the third threshold detector 22, the third threshold detector 22 outputs an inverse signal which is supplied to the D input of a latch 24. The clock input to the latch 24 is supplied from the inverse output of the fourth one shot 20. The output of the latch 24 is supplied to the OR gate 48. Finally, the output of the latch 24 is supplied to an LED 26 which is a trouble indicator.

The operation of the audio intrusion detection system 30 is well known in the art. Typically, when an intruder enters into a protected premise, such as by breaking the glass, a pressure wave is first generated. The pressure wave precedes the sound of intrusion, such as the sound of the breaking of the glass. The pressure wave is detedted by the microphone 32 generating the signal 33. The pressure wave signal is filtered and amplified by the second bandpass amplifier filter 36. The amplified pressure wave signal is then compared by the second threshold, detector 40. If the magnitude of the amplified pressure wave signal exceeds the preset threshold, then a pressure alarm signal is generated by the second threshold detector 40. The pressure alarm signal is supplied to the second one shot 44 which maintains the pressure alarm signal for a predetermined period of time. In the preferred embodiment, this is a time period of approximately 0.2 seconds.

The pressure alarm signal is then supplied to the AND gate 46. Assuming now that the clock 16 of the supervisory circuit 10 is not active, then the output of the third one shot 18 would be low. The low signal from the third one shot 18 supplied to the inverse input and the AND gate 46 would cause the AND gate 46 to go high. This would enable the first threshold detector 42.

If the pressure wave is followed by the audio intrusion sound, the microphone 32 would convert the audio intrusion sound into an audio intrusion signal 33. The signal 33 is supplied to the first bandpass amplifier filter 34 which amplifies the audio intrusion signal. The amplified audio intrusion signal from the first bandpass amplifier filter 34 is supplied to the envelope detector 38, which functions as previously described. The output of the envelope detector 38 is then supplied to the threshold detector 42.

Assuming that the threshold detector 42 has been enabled by the output of the second one shot 44, the first threshold detector 42 receives the amplified audio intrusion signal and compares it to a preset threshold. If the amplified audio intrusion signal is greater than the preset threshold, an audio alarm signal is generated. The audio alarm signal from the output of the first threshold detector 42 is supplied to the OR gate 48.

Since one of the input to the OR gate 48 has gone high, the output of the OR gate 48 would be high. This is supplied to the first one shot 50 which maintains it for a predetermined period of time. In the preferred embodiment, the first one shot 50 maintains the signal approximately four (4) seconds. The output of the first one shot 50 is an alarm indicating the detection of an intruder.

The supervisory circuit 10 functions to periodically check the integrity or the operability of the audio intrusion system 30. This is accomplished in the following manner. The clock 16 periodically and regularly (except as described hereinafter with regard to reset) generates a clock signal. In the preferred embodiment, the clock signal is a square wave signal, having a fifty percent (50%) duty cycle. The period of the clock signal (without any reset) is approximately nineteen (19) hours. The signal is supplied to the third one shot 18 which is triggered on the rising edge of the clock signal. The third one shot 18 generates a pulse lasting approximately 0.5 seconds. The output of the third one shot 18 is supplied on the negative input to the AND gate 46. Thus, when the third one shot 18 is high, the output of the AND gate 46 would be low thereby disabling the first threshold detector 2. Therefore, during the time period when the third one shot 18 is active, i.e., during the self-test time period, the first threshold detector 42 is disabled preventing the audio intrusion detection system 30 from generaling an alarm signal at the alarm output.

The clock signal from the clock 16 is also supplied to the fourth one shot 20, which also generates a pulse signal, in response to the rising edge of the clock signal. The pulse signal, generated by the fourth one shot 20 lasts for only half as long as the third one shot 18. The fourth one shot 20 will output a signal lasting approximately 0.22 seconds, which is supplied to the driver 14 and to the sounder 12. The test sound generated from the sounder 12 is emitted into the volume of space being monitored. The microphone 32 is directed to receive the sound from the volume of space into which the sounder 12 has emitted the audio test sound. When the microphone 32 receives the test sound, a test signal 33 is generated which is supplied to the first bandpass amplifier filter 34. The amplified filtered signal from the first bandpass amplifier filter 34 is then supplied to the envelope detector 38. The output of the envelope detector 38 is then supplied to the first and third threshold detectors 42 and 22, respectively. As previously stated, the first threshold detector 42, during the time period in which the fourth one shot 20 is active and for a similar time period thereafter, is inactivated. Thus, the signal from the envelope detector 38 is supplied only to the third threshold detector 22.

During the time period in which the fourth one shot 20 is active, it also activates or enables the third threshold detector 22. This permits the signal from the envelope detector 38 to be compared by the third threshold detector 22. Within the third threshold detector 22, the signal from the envelope detector 38 is compared to a preset threshold level. If the signal from the envelope detector 38 exceeds the preset threshold level from the third threshold detector 22, the signal would be high. This would indicate that the audio detection portion system of the intrusion detection system 30 is operational.

Since the inverse output of the third threshold detector 22 is supplied to the trouble latch 24, if the signal from the envelope detector 38 exceeds the preset threshold level, the signal supplied to the trouble latch 24 would be low. Upon the dropping of the signal from the fourth one shot 20, the inverse output thereof is supplied as the clock input to the trouble latch 24, clocking the inverse output from the third threshold detector 22 into the trouble latch 24. At this point, if the audio intrusion detection system 30 is operational, the trouble latch 24 would contain a low signal. Thus, the output of the trouble latch 24 would be low. This would not turn on the trouble indicator LED 26. In addition, the low output of the trouble latch 24 would be supplied to the OR gate 48. The output of the 0R gate 48 would also be low. Thus, no alarm output would be generated.

As previously discussed, in the operation of the audio intrusion detection system 30, the output of the second one shot 44 is used to enable the first threshold detector 42. Thus, the pressure wave must be detected prior to an intrusion sound being activated. If a pressure wave is detected, then the pressure wave portion of the audio intrusion system 30 is activated. When a pressure wave is detected, the pressure wave signal also serves to reset the clock 16. This serves to prevent the clock 16 from generating a test audio signal which would conflict with the normal operation of a possible audio intrusion sound being generated immediately after the presence of a pressure wave. Therefore, with the supervisory circuit 10, the pressure wave signal serves to inhibit the generation of the audio test sound.

Figures 2, 2A, 2B, 2C, 2D:
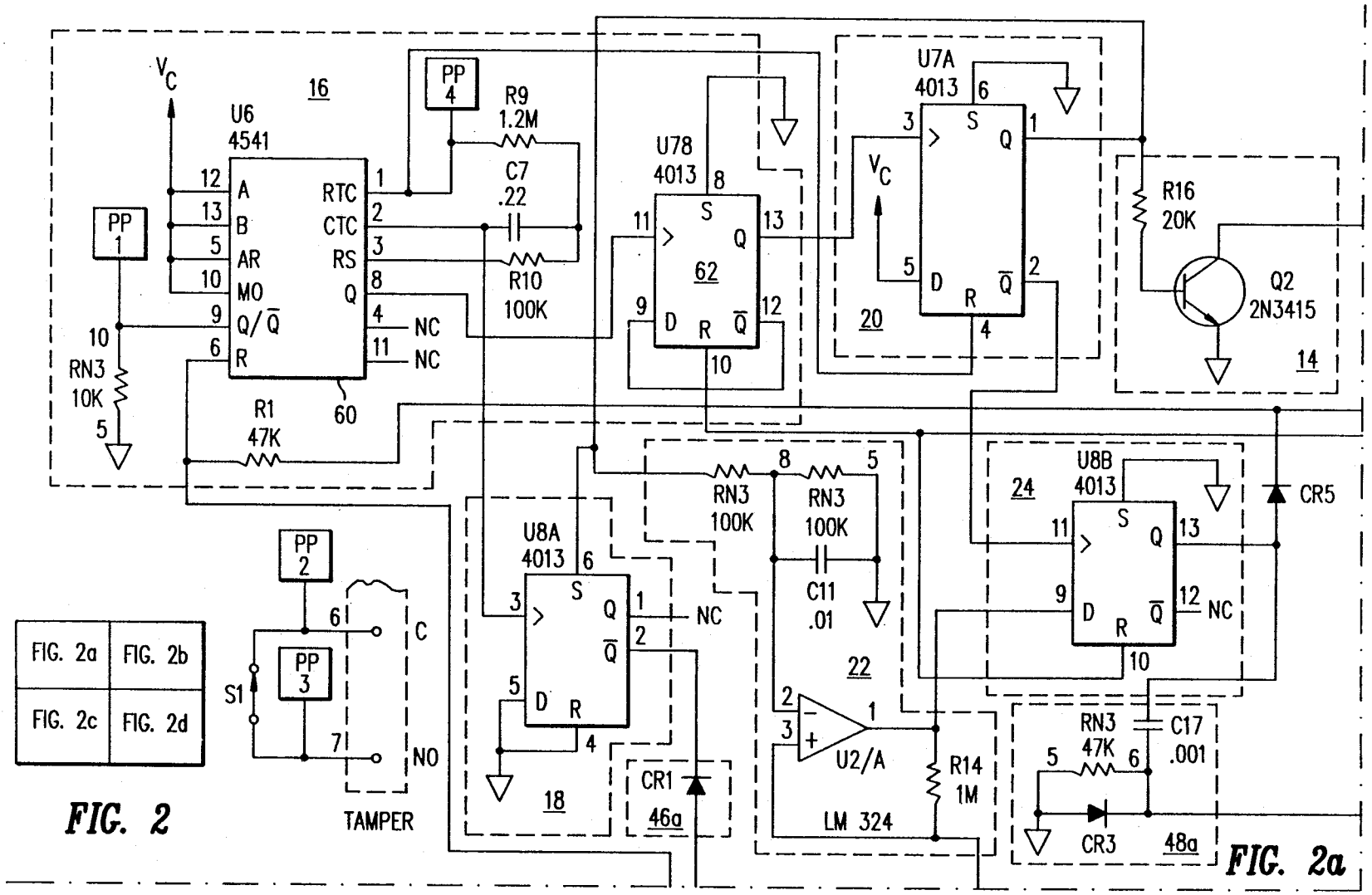
FIG. 2 is a detailed circuit diagram of the supervisory circuit and the audio intrusion detection system shown in FIG. 1.
Figure 2B:
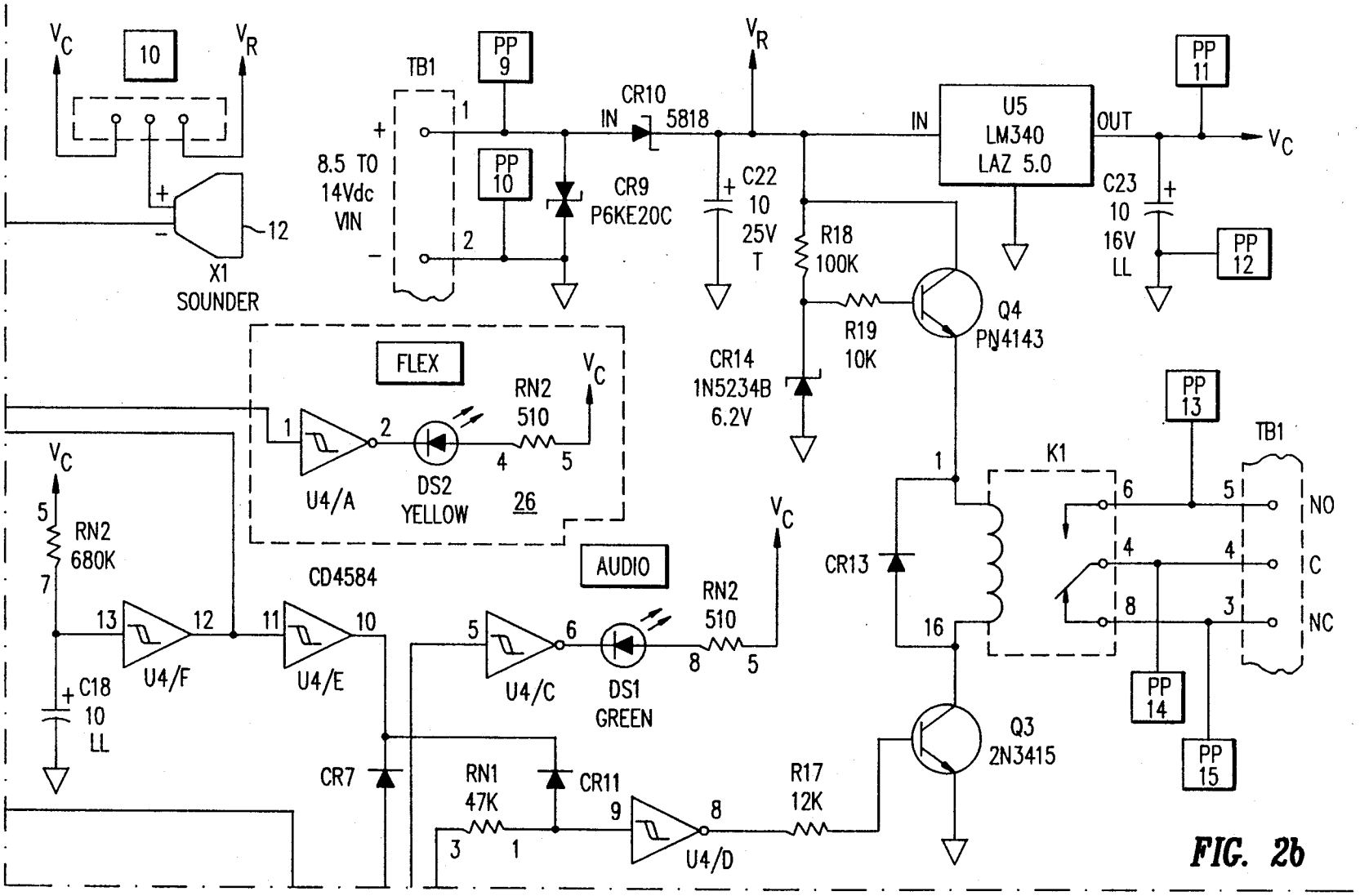
Figure 2C:
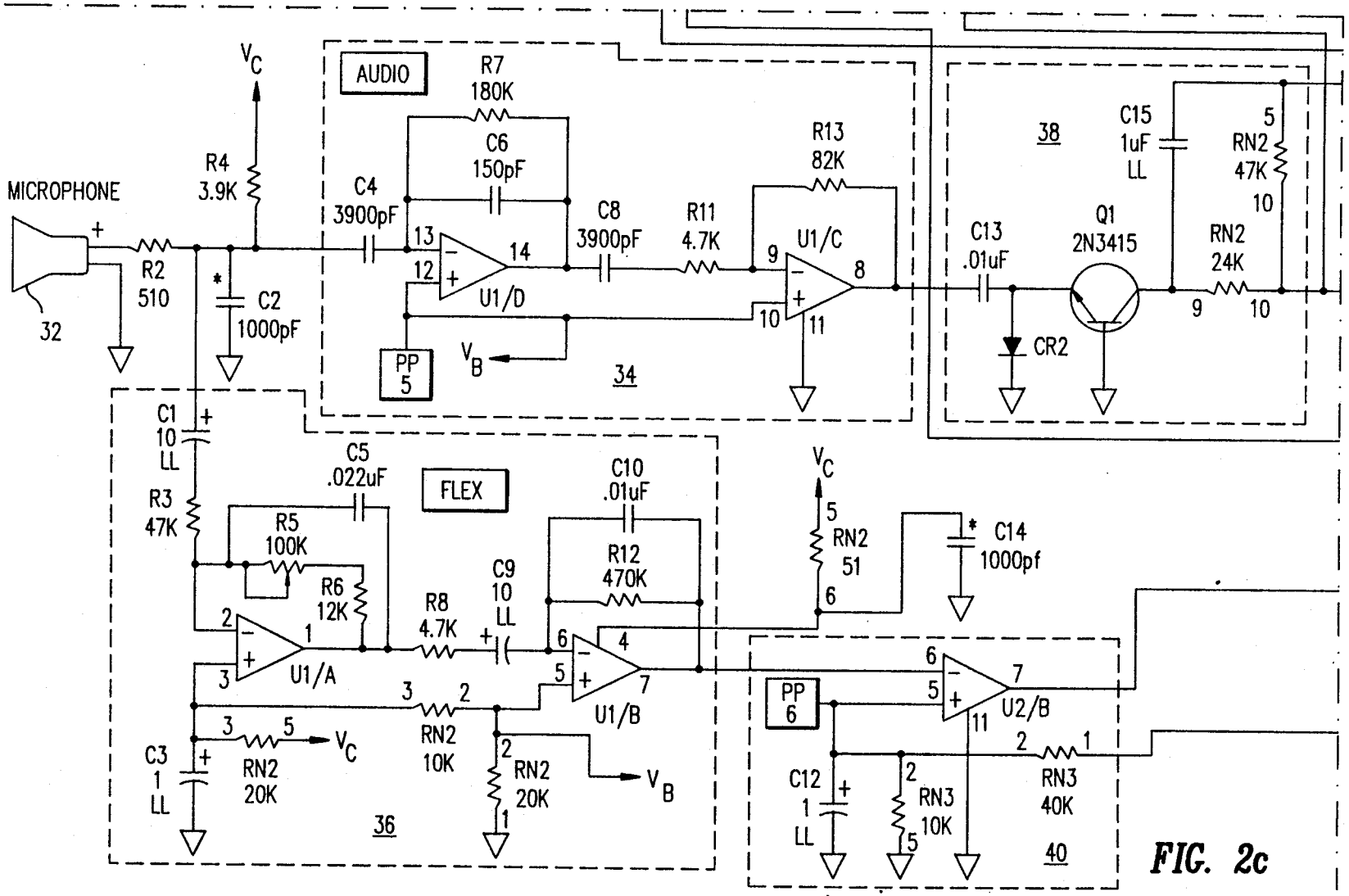
Figure 2D:
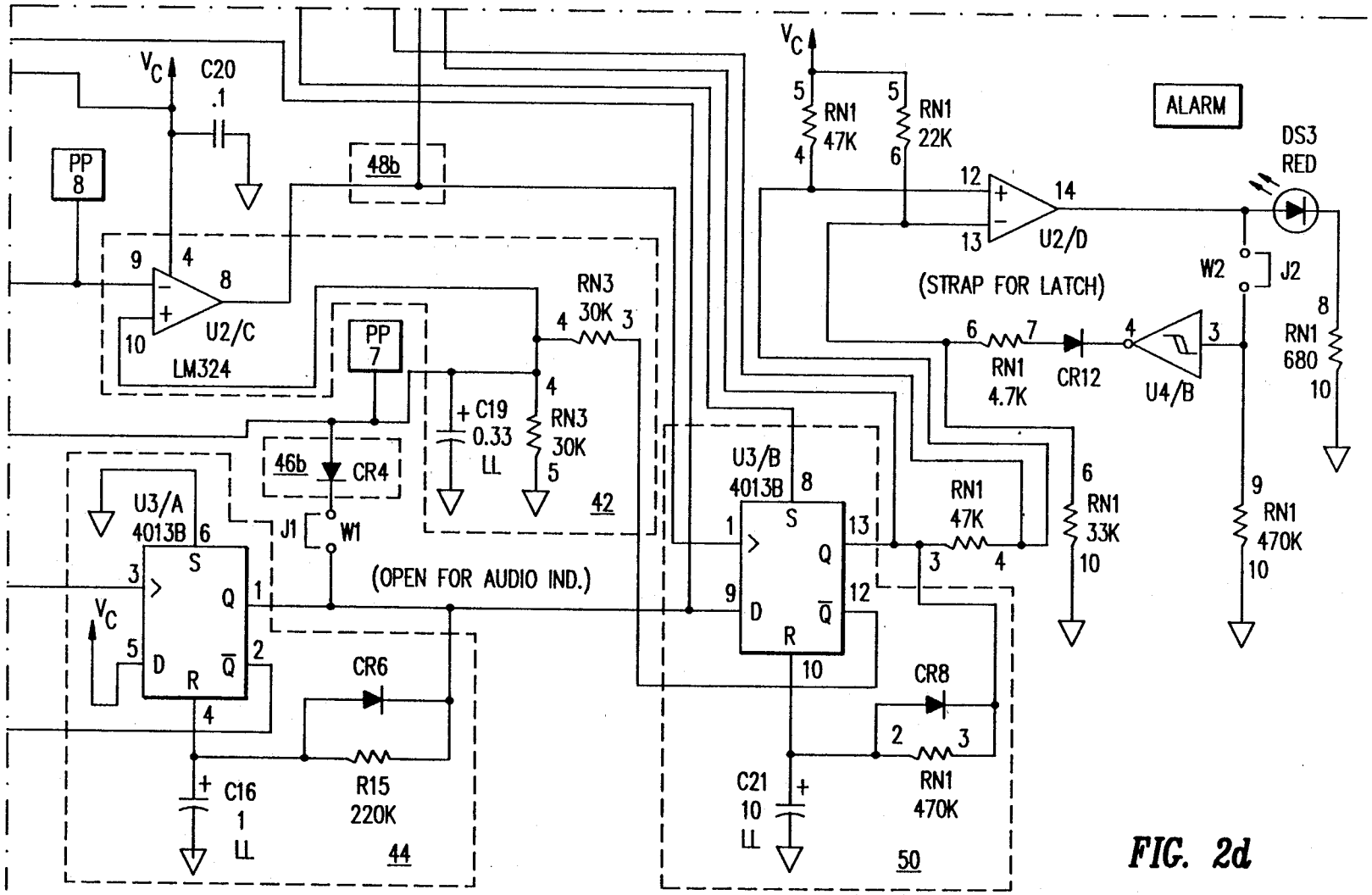

Referring to FIG. 2, there is shown in greater detail a circuit diagram of the invention shown in FIG. 1. The various components labeled in FIG. 1 are shown in greater circuit detail in FIG. 2. The corresponding block level diagram components have the corresponding circuit elements shown in FIG. 2. The AND gate 46 comprises two diodes 46A and 46B. The OR gate 48 is a logical simplification of the circuit shown in FIG. 2. The first one shot 50, as shown in FIG. 2, comprises an integrated circuit U3/B, which can be triggered at either of two inputs: clock input at pin 11, or set input at pin 8. Thus, the OR gate 48 which triggers the first one shot 50 comprises the output of threshold detector 42 (node 8*b*) supplied to pin 11, and an R-C circuit 48*a*, supplied to pin 8. The R-C circuit 48*a* is a pulse forming circuit to drive pin 8, from the output of latch 24.

The reset of the clock 16 will now be explained with reference to FIG. 2. The clock 16 comprises a timer 60 (U6) and a flip-flop 62 (U7B). The timer 60 outputs a square wave having a duty cycle of approximately 50%. The flip-flop 62 receives the square wave from the timer 60, and is triggered on the rising edge of the timer signal. The output of the flip-flop is also a square wave having a 50% duty cycle and a period of approximately 19 hours (hereinafter designated as $T_c$). The flip-flop is wired to "divide-by-2". Thus, the signal from the timer 60 is provided at a period of approximately $T_c/2$.

Immediately upon power up, the outputs of both the timer 60 and the flip-flop 62 are low. The timer 60 runs and after one-half of its periodicity (i.e. ½ of $T_c/2$ or $T_c/4$), the output will go high. Since the flip-flop 62 is triggered on the rising edge of the input signal, the output of the flip-flop 62 will also go high. This would then trigger the one shots 18 and 20 and generate a test. Thus, the total delay from power up to the first test is $T_c/4$ (barring any reset caused by alarm detection).

In the event a signal is generated by the one shot 44, the signal from the one shot 44 is supplied to the timer 60 - but not to the flip-flop 62, to reset the timer 60. On reset, the timer 60 reinitializes by going low. After another period of $T_c/4$, the output of the timer 60 will be high again. state prior to receiving the output from the timer 60.

If the flip-flop 62 is low, the high output of the timer 60 will cause the flip-flop 62 to go high, thereby initiating a test. Thus, a test is initiated in $T_c/4$ time period after the reset.

If the flip-flop 62 is high, the transition of the output of the timer 60 will cause the flip-flop 62 to go low. This, however, has no effect on the one-shots 18 and 20 , which are triggered on the rising edge of the signal from the flip-flop 62. The timer 60 goes low again in another $T_c/4$ time period. This also has no effect on the flip-flop 62. Finally, when the timer goes high in another $T_c/4$ time period, the flip-flop 62 goes high, which triggers the one shots !8 and 20 to start the test. Thus, in this case, a test is initiated in $3T_c/4$, after the rest.

The above assumes that there are no additional intervening resets caused by the one-shot 44.

Therefore, as can be seen from the foregoing, the supervisory circuit 10 with the audio intrusion detection system 30 provides the benefit of the dual sensing technology of the audio intrusion detection system 30 as well as the reliability of a supervisory circuit 10.

What is claimed:

1. A supervisory circuit for use with an audio intrusion detection system having means for generating an audio signal in response to the detection of an audio intrusion sound, means for comparing said audio signal to an audio threshold signal, and means for generating an audio alarm signal in response to said comparison, said supervisory circuit comprising:

means for generating a test audio sound;

means for disabling said comparing means of said audio intrusion detection system during the generating of said test audio sound;

means for receiving said audio signal from said audio intrusion detection system, generated in response to the detection of said test audio sound, and for comparing said audio signal to a test threshold signal; and means for generating a test result signal in response to said comparison, said test result signal indicative of the operability of said audio intrusion detection system.

2. The circuit of claim 1 wherein said audio intrusion detection system further comprises:

means for generating a pressure signal in response to the detection of a pressure wave generated;

means for comparing said pressure signal to a pressure threshold signal; and means for generating a pressure alarm signal in response to said comparison.

3. The circuit of claim 2 wherein said supervisory circuit further comprises means responsive to said pressure alarm signal for disabling the commencement of the generation of said test audio sound.

4. The circuit of claim 3 wherein said responsive means is a clock circuit having a reset, with said pressure alarm signal being supplied to said reset.

5. A supervisory circuit for use with an audio intrusion detection system having means for generating an audio signal in response to the detection of an audio intrusion sound, means for comparing said audio signal to an audio threshold signal, and means for generating an audio alarm signal in response to said comparison, said supervisory circuit comprising:

means for generating a test audio sound;

means for disabling the generation of an alarm signal by said audio intrusion detection system, during the generation of said test audio sound; and means for disabling the commencement of the generation of said test audio sound in response to the generation of an alarm signal by said audio intrusion detection system.

6. The circuit of claim 5 wherein said audio intrusion detection system further comprises:

means for generating a pressure signal in response to the detection of a pressure wave generated;

means for comparing said pressure signal to a pressure threshold signal; and means for generating a pressure alarm signal in response to said comparison.

7. The circuit of claim 6 wherein said responsive means is a clock circuit having a reset, with said pressure alarm signal being supplied to said reset.

8. An improved intrusion detection system comprising:

means for generating a pressure signal in response to the detection of a pressure change caused by an intruder in a volume of space;

means for generating an audio signal in response to the detection of an audio sound caused by the intruder in the same volume of space;

means for generating an alarm signal in response to said pressure signal and said audio signal;

means for generating a test audio sound to test said system; and means for disabling the generation of the audio signal during the generation of said test audio sound.

9. The system of claim 8 further comprising:

means for disabling the commencement of the generation of said test audio sound in response to the generation of said pressure signal.

10. The system of claim 8 wherein said means for generating said audio signal further comprises:

microphone means for gathering said audio sound and for generating a first audio signal in response thereto;

bandpass amplifier means for receiving said first audio signal and for generating an amplified first audio signal in response thereto; and threshold detecting means for receiving said amplified first audio signal and having an enabling port for receiving an enabling signal for generating said audio signal in response to said threshold detecting means being enabled by said enabling signal and said amplified first audio signal exceeding a threshold level.

11. The system of claim 10 wherein said means for disabling further comprises:

means for generating a disabling signal, which is the inverse of said enabling signal, during the generation of said test audio sound; said disabling signal supplied to said threshold detecting means for disabling said threshold detecting means.

12. The system of claim 9 further comprising:

clock means, having a reset input for generating a test audio signal in response to said clock means reaching a predetermined time.

13. The system of claim 12 wherein said means for disabling the commencement of the generation of said test audio sound comprises said pressure signal being supplied to the reset input to said clock means.

14. The system of claim 13 wherein said means for generating said pressure signal further comprises:

microphone means for gathering said pressure change and for generating a first pressure signal in response thereto;

bandpass amplifier means for receiving said first pressure signal and for generating an amplified first pressure signal in response thereto; and first threshold detecting means for receiving said amplified first pressure signal and for comparing same to a threshold level and for generating said pressure signal in response thereto.

15. The system of claim 14 wherein said means for generating said audio signal further comprises:

microphone means for gathering said audio sound and for generating a first audio signal in response thereto;

bandpass amplifier means for receiving said first audio signal and for generating an amplified first audio signal in response thereto; and threshold detecting means for receiving said amplified first audio signal and having an enabling port for receiving an enabling signal for generating said audio signal in response to said threshold detecting means being enabled by said enabling signal and said amplified first audio signal exceeding a threshold level.

16. The system of Claim 15 wherein said means for disabling further comprises:

means for generating a disabling signal, which is the inverse of said enabling signal, during the generation of said test audio sound; said disabling signal supplied to said threshold detecting means for disabling said threshold detecting means.

* * * * *